US007168278B2

(12) United States Patent
Derichs

(10) Patent No.: US 7,168,278 B2
(45) Date of Patent: Jan. 30, 2007

(54) DEEP ROLLING ROLLER HEAD OF A DEEP ROLLING TOOL

(75) Inventor: Heinrich-Wilhelm Derichs, Wegberg (DE)

(73) Assignee: Hegenscheidt-MFD GmbH, Erkelenz (DE)

( * ) Notice: Subject to any disclaimer, the term of this patent is extended or adjusted under 35 U.S.C. 154(b) by 0 days.

(21) Appl. No.: 10/526,204

(22) PCT Filed: Feb. 15, 2003

(86) PCT No.: PCT/EP03/01531

§ 371 (c)(1),
(2), (4) Date: Feb. 24, 2006

(87) PCT Pub. No.: WO03/090971

PCT Pub. Date: Nov. 6, 2003

(65) Prior Publication Data

US 2006/0150700 A1 Jul. 13, 2006

(30) Foreign Application Priority Data

Apr. 26, 2002 (DE) ..... 102 18 703

(51) Int. Cl.
*B21O 15/00* (2006.01)

(52) U.S. Cl. ..... 72/110

(58) Field of Classification Search ..... 72/107, 72/110; 29/6.01

See application file for complete search history.

(56) References Cited

U.S. PATENT DOCUMENTS 6,257,037 B1 * 7/2001 Lonero et al. ..... 72/110
6,393,886 B1 * 5/2002 Bagusche ..... 72/110
6,601,424 B1 * 8/2003 Bagusche ..... 72/110
2002/0020202 A1 2/2002 Bagusche

FOREIGN PATENT DOCUMENTS

| | | |
|---|---|---|
| DE | 10 05 869 B | 4/1957 |
| EP | 0 661 137 A | 7/1995 |
| EP | 0 839 607 A | 5/1998 |
| WO | 03/090972 A1 | 11/2003 |

OTHER PUBLICATIONS

Copy of search report for PCT/EP03/01531 in English and German.

* cited by examiner

*Primary Examiner*—Ed Tolan
(74) *Attorney, Agent, or Firm*—Proskauer Rose LLP

(57) ABSTRACT

The invention relates to a deep rolling roller head (1) of a deep rolling tool for deep rolling radii or recesses (22) on the main and lifting bearing journals of crankshafts (21). Said deep rolling roller head is equipped with a housing (2) inside of which one or two laterally interspaced deep rolling rollers (4) are rotationally guided in a loose manner and with little play in two roller cages (5, 6). The roller cages (5, 6) are fastened to supports (15) on the face (3) of the housing (2) oriented toward the crankshaft (21). Said supports support the roller cages (5, 6) on their faces (10) oriented away from the deep rolling rollers (4) while laterally guiding them at the same time. The face (3) of the housing (2) oriented toward the crankshaft (21) is provided, on both ends thereof, with a projection (11, 12) for supporting each of the roller cages (5, 6). A fastening and guiding element (15) is provided for each roller cage (5, 6), engages inside the roller cage (5, 6), and can be fastened to one of the projections (11, 12) of the housing (2) at the same time.

5 Claims, 2 Drawing Sheets

DEEP ROLLING ROLLER HEAD OF A DEEP ROLLING TOOL

This application is a 35 USC 371 of PCT/EP03/01531, filed Feb. 15, 2003.

The invention relates to a deep rolling roller head of a deep rolling tool for deep rolling radii or recesses on the main and lifting bearing journals of crankshafts with a housing in which one or two deep rolling rollers are rotationally guided in a loose manner and with little play respectively in two roller cages at a lateral distance from each other equal to the axial width of the corresponding bearing journal and the roller cages are fastened to supports on the face of the housing oriented toward the crankshaft supporting the roller cages respectively on their faces away from the deep rolling rollers and at the same time move them laterally. Deep rolling roller heads of this type are known e.g. from the following printed documents;

1. EP 0 661 137 B1, FIG. 6,
2. EP 0 683 012 B1, FIG. 4,
3. EP 0 839 607 A1, FIG. 1,
4. U.S. Pat. No. 5,575,167, FIG. 7 and
5. U.S. Pat. No. 5,806,184, FIG. 2*a*

The known deep roller heads have in common that the roller cages are attached on the housing of the deep roller head by means of L-shaped supports. The roller cages can be brought into a predetermined position by means of the supports and can be fixed on the deep rolling roller head. The roller cages are rotationally guided in a loose manner with little play. This play amounts in general to approximately 0.2 mm. In addition, the deep rolling rollers are offset by approximately 0.2 mm relative to the center of the housing of the deep rolling roller head around which a guide roller of the deep rolling rollers rotates. In addition the deep rolling rollers in the deep rolling roller head are spread out in axial direction.

The precise, i.e. predetermined position of the deep rolling rollers in the deep rolling roller head plays a decisive role in its serviceable life. In spite of precise adjustment, wear does occur and enlarges the play between the deep rolling rollers and the roller cages in the course of utilization of the deep rolling tool. It can be seen that as a result the precise adjustment of the deep rolling rollers in the deep rolling roller head is of special importance. The adjustment of the deep rolling roller heads known in the state of the art is effected via L-shaped supports of the roller cages. In the most favorable case adjustment templates are provided for this adjustment. It is however also customary to have the adjustment made manually by a trained specialist. In that case it has however been noticed that the life span of the deep rolling rollers and of the roller cages is influenced considerably by the dexterity of the adjusting specialist. The adjustment of the deep rolling rollers is furthermore a time-consuming activity requiring much work time.

The object of the present invention, to improve a deep rolling roller head so that precise adjustment of the deep rolling rollers becomes possible without special dexterity or great work time expenditure, is derived from the above. It should also be possible to compensate for the wear occurring on the roller cages. At the same time the serviceable life of the deep rolling rollers and of the roller cages as well as the quality of the deep-rolled product is to be extended. Finally, the improvement should be simple and economical and it should be possible also for specialists with little training to apply it with the required precision.

The object is attained through a novel configuration of the housing of the deep rolling roller head, in that the housing is provided with a projection at each of the two ends of the face toward the crankshaft for the support by each of one of the two roller cages and in that a fastening and guiding element is provided for each roller cage, engages inside the roller cage and can be fastened to the projection of the housing.

From then on the known L-shaped supports of the roller cages and their time-consuming adjustment on the housing of the deep rolling roller head are omitted, so that considerable simplification is achieved. By pulling down the two outer ends of the face of the housing of the deep rolling roller head toward the crankshaft, stops are easily obtained to support the faces of the two roller cages which are away from the deep rolling rollers. To this end modern manufacturing methods are used, making it possible to create a precise recess between the two projections of the face of the housing. Fabricated roller cages are then inserted with great precision into this recess so that as a result the planned play of 0.2 mm can be maintained between the roller cages and the deep rolling rollers. The modern manufacturing methods also make it possible to establish the lateral offset of the rotational axes of the deep rolling rollers relative to the center of rotation of the housing of the deep rolling roller head.

When wear occurs, the possibility is then provided to insert additional spacers in function of the occurring wear between the ends of the housing and the faces of the roller cages bearing upon them, these spacers having a thickness, depending on the wear ascertained, between 0.1 and 0.5 mm, preferably 0.2 mm. According to another advantageous embodiment one or two spacers in the ends of the housing of the deep rolling roller head can be provided so as to be movable towards the deep rolling rollers making it possible to adjust them and set them in different positions by means of fine-tuned adjustment. In this case the wear of the roller cages, as soon as it becomes noticeable, can be compensated for from time to time by readjusting the spacer or spacers.

The new design of the housing of the deep rolling roller head changes nothing on the roller cages themselves. As before they are provided with a longitudinal groove on their underside towards the crankshaft via which they are held on the housing by a suitable element and are moved laterally.

According to the invention the element consists of a simple support, one end of which is screwed to the projection of the housing while the other, free end, engages into the groove on the underside of the roller cage. It is however possible to provide only one single support bridging the two roller cages and screwed in detachable manner by both of its ends to the projections of the housing of the deep rolling roller head.

Thanks to these simple measures the time-consuming and precision-lacking adjustment of the roller cages by means of the known L-shaped supports to the housing of the deep rolling roller head can be omitted. The spacer which can be inserted between a projection and a roller cage can serve as described earlier to obtain the offset of the deep rolling roller and also to compensate to a certain degree for the wear of the roller cages.

The invention is described in further detail below through an example of an embodiment.

Figure 1:
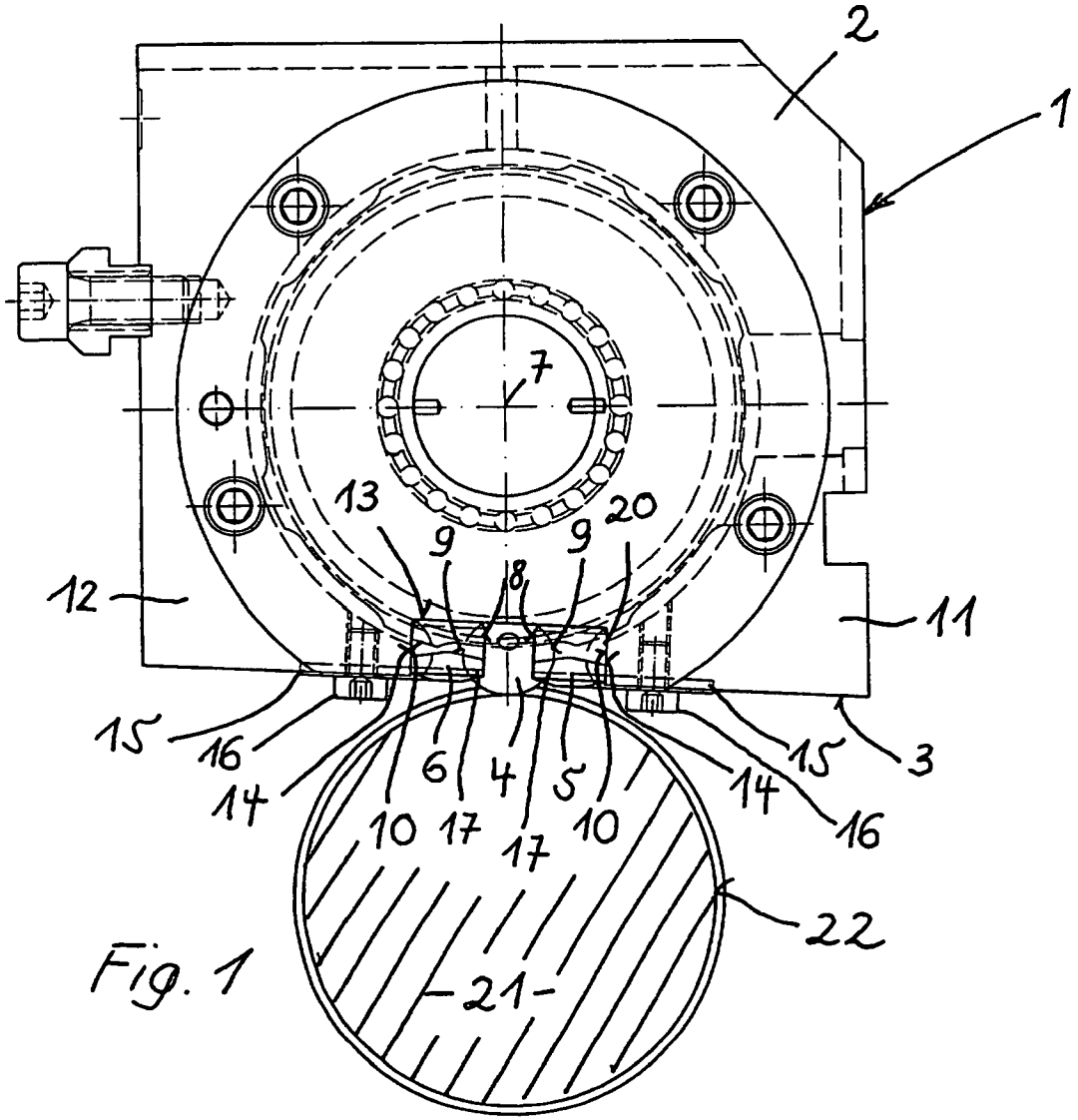
FIG. 1 shows a deep rolling roller head in a lateral view.

The deep rolling roller head 1 has a nearly rectangular, flat housing 2. The underside 3 of the housing 2 is turned toward the crankshaft 21 of which FIG. 1 shows the section through any main bearing, the bearing journal of which is delimited laterally by radii or recesses 22. Deep rolling rollers 4 engage into these radii or recesses 22 and are in turn installed with little play between two adjoining roller cages 5 and 6. When the deep rolling tool is new the play between the deep rolling roller 4 and the two roller cages 5 and 6 is approximately 0.1 mm to 0.5 mm, preferably 0.2 mm. The faces 8 of the two roller cages 5 and 6 are at a lateral distance from each other and also at a lateral distance from the center of rotation 7 of the housing 2.

Figure 2:
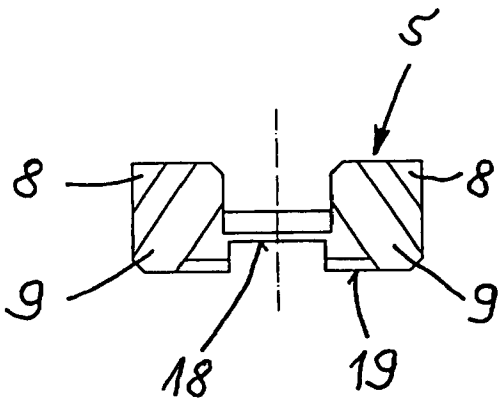
FIG. 2 shows a roller cage in a frontal view.

On their faces 8 turned toward each other the roller cages 5 and 6 are provided with groove-shaped recesses 9 in which deep rolling rollers 4 are moved rotatably on two sides across from each other at the circumference of its body. FIG. 2 shows the two recesses 9 at the face 8 of a roller cage 5. The inclined position of the two recesses 9 seen in FIG. 2 matches at the same time the inclined position of the deep rolling roller 4 in the deep rolling roller head 1.

On the face 10 across from the face 8 the roller cages 5 and 6 are supported on corresponding projections 11 and 12. The projections 11 and 12 project from the underside 3 of the housing 2 and leave a recess 13 between them in which the two roller cages 5 and 6 and the deep rolling rollers 4 are received. The roller cages 5 and 6 are not connected to the housing 2 or to its projections 11 and 12. They are mounted and loosely and move in the recess 13 between the two projections 11 and 13. The roller cages 5 and 6 bear with their rear faces 10 on corresponding surfaces 14 of the projections 11 and 12.

Two supports 15 are provided to hold each of the roller cages 5 and 6 on the housing 2. The supports 15 consist of flat iron pieces of little length and width that are connected in a detachable manner by means of screws 16 to the respective projection 11 or 12 of the housing 2. The freely extending forward end of each of the two supports 15 engages in a groove 18 on the underside 19 of the roller cage 5 and 6 FIG. 2. Instead of two supports 15 it is also possible to use one single support reaching over the two roller cages 5 and 6 and bridging the distance between their faces 8.

If necessary, a spacer 20 of little thickness in the order of 0.1 mm to 0.5 mm, preferably 0.2 mm is inserted between two adjoining surfaces 10 and 14. The play between the deep rolling roller 4 and the two roller cages 5 and 6 can be compensated for by means of the spacer 20. At the same time the spacer 20 also serves to adjust the center of rotation of the deep rolling roller 4 relative to the center of rotation 7 of the housing 2 to a small extent which lies also between 0.1 mm and 0.5 mm, preferably 0.2 mm.

Instead of the support 15 it is also possible to use a pin which ensures the support and guidance of the roller cages 5 and 6 on the projections 11 and 12 of the housing 2.

Figures 3, 4:
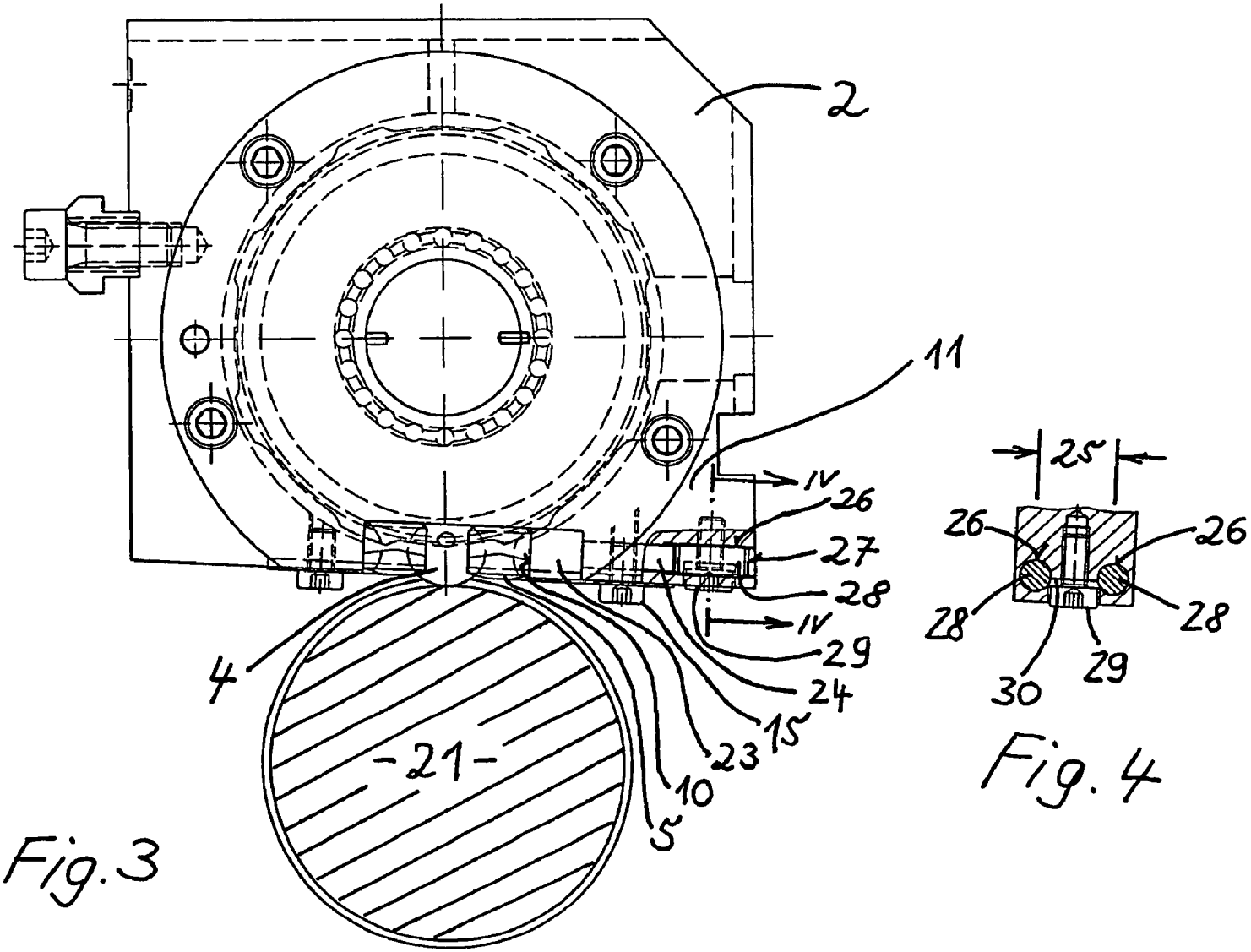
FIG. 3 shows another deep rolling roller head with partially cut-away lateral view and FIG. 4 shows a longitudinal section through the deep rolling roller head of FIG. 3 along line IV—IV.

The spacer 23 of FIG. 3 is a prismatic body whose axial length is substantially greater than the thickness of the spacer 20 of FIG. 1. FIG. 3 shows only one single spacer 23 supporting the adjoining roller cage 5 on its rear face 10. In analogous manner the roller cage 6 can also be assigned a spacer similar to the spacer 23.

As can be seen in FIG. 4, the spacer 23 is moved on two cylindrical journals 24 which engage in the bore 26 within the projection 11 of the housing 2 and are at a distance 25 from each other. The journals 24 are part of the spacer 23 and are permanently and non-detachable connected to it. The distance 25 provides space for the entry of the screw 16 of support 15 into the projection 11.

At their outer ends 27 the two bores 26 are each closed off by grub screws 28 whose positions within the bore 26 can be adjusted from end 27. The spacer 23 bears with its two journals 24 on the grub screws 28. By adjusting the grub screws 28 the exact position of the spacer 23 and thereby the position of the roller cage 5 on the housing 2 of the deep rolling roller head 1 is adjusted.

Once the exact, i.e. predetermined position of the roller cage 5 is set, the two grub screws 28 are fixed by a screw 29 which acts upon the two grub screws 28 via a soft plain washer 30. The position of the spacer 23 and thereby the position of the roller cages 5 and 6 relative to the deep rolling rollers 4 is adapted as needed to the wear of the roller cages 5 and 6 by adjusting the grub screws 28 and tightening the screw 29.

LIST OF REFERENCE NUMBERS

1 deep rolling roller head
2 housing
3 underside
4 deep rolling roller head
5 roller cage
6 roller cage
7 center of rotation
8 face
9 recess
10 face
11 projection
12 projection
13 recess
14 supporting surface
15 support
16 screw
17 forward end
18 underside
19 groove
20 spacer
21 crankshaft
22 radii or recesses
23 spacer
24 journal
25 distance
26 bore
27 end of bore
28 grub screw
29 screw
30 plain washer

The invention claimed is:

1. Deep rolling head of a deep rolling tool for deep rolling radii or recesses on the main and lifting bearing journals of crankshafts with a housing in which one or two laterally interspaced deep rolling rollers are rotationally guided in a loose manner and with little play in two roller cages and in which the roller cages are fastened to supports bearing the roller cages on their faces oriented away from the deep rolling rollers and at the same time guiding them laterally, characterized in that the housing (2) is provided at each of the two ends of its face (3) oriented towards the crankshaft (21) with a projection (11, 12) for the support by each of one of the two roller cages (5, 6) and in that a fastening and guiding element (15) is provided for the roller cages (5, 6) which engages inside each roller cage (5, 6) and can be attached to the projection (11, 12) of the housing (2).

2. Deep rolling roller as in claim 1, characterized in that the fastening element is in form of a support (15) engaging inside a longitudinal groove (18) of the respective roller cage (5, 6) and is provided on its underside (3) oriented toward the crankshaft (21).

3. Deep rolling roller head as in one of the claims 1 or 2, characterized in that a spacer (20, 23) is installed between the projection (11, 12) of the housing (2) and the face (10) of the roller cage (5, 6) supported on it.

4. Deep rolling roller head as in claim 3, characterized in that the spacer (23) can be displaced in the direction of the adjoining roller cage (5).

5. Deep rolling roller head as in claim 4, characterized in that the position of the spacer (23) can be fixed.

* * * * *